United States Patent [19]

Beam, Jr. et al.

[11] 4,175,480

[45] Nov. 27, 1979

[54] WALL VENTILATOR CONSTRUCTION

[76] Inventors: Dennis A. Beam, Jr., Westfield Rd.; Paul M. Sarazen, Jr., 214 Fairway Dr., both of Shelby, N.C. 28150

[21] Appl. No.: 869,057

[22] Filed: Jan. 13, 1978

[51] Int. Cl.[2] ..... F24F 7/00

[52] U.S. Cl. ..... 98/37; 98/110; 98/114; 236/49

[58] Field of Search ..... 98/37, 101, 107, 108, 98/110, 114, 116, 121 R, 121 A, 29, 40 VT; 236/49; 49/504

[56] References Cited

U.S. PATENT DOCUMENTS

| | | | |
|---|---|---|---|
| 1,438,981 | 12/1922 | Christensen | 98/114 |
| 2,565,122 | 8/1951 | Cowan | 98/37 |
| 3,204,548 | 9/1965 | McCabe | 98/110 |
| 3,306,178 | 2/1967 | Manino | 98/114 |
| 3,368,756 | 2/1968 | Edwards | 98/37 |
| 3,436,016 | 4/1969 | Edwards | 236/5 |
| 3,528,606 | 9/1970 | Witten | 236/49 |
| 3,938,430 | 2/1976 | Koppang | 98/107 |
| 4,089,257 | 5/1978 | Dunne | 98/121 R |

*Primary Examiner*—Henry C. Yuen

*Attorney, Agent, or Firm*—Wellington M. Manning, Jr.; Luke J. Wilburn, Jr.

[57] ABSTRACT

An improved ventilator construction for use in masonry wall openings to ventilate interior spaces of a building, such as a basement or crawl space of a home, wherein the ventilator construction is particularly adapted for installation in an existing masonry wall opening without the need for concrete or mortar to retain the ventilator in place in the wall opening. The ventilator construction comprises a ventilator box having adjustable louvers for automatically controlling the access of air through the ventilator in response to changes in temperature, and a support frame for the ventilator box having a flanged peripheral opening for overlying the opening in the masonry wall. The support frame and ventilator box are connected to each other and to the masonry wall by means of depending ear-shaped connection elements on the ventilator box which have holes, or openings, which align with corresponding holes, or openings, in the side walls of the support frame whereby suitable fastening means, such as masonry nails, may be employed to connect the frame and ventilator box to the masonry wall itself.

5 Claims, 3 Drawing Figures

WALL VENTILATOR CONSTRUCTION

This invention relates to a ventilator construction for ventilating interior spaces of a building and, more particularly, to an improved ventilator construction which may be quickly and easily installed in an opening of an existing masonry wall.

It is a standard practice to provide ventilation to enclosed spaces of buildings, such as crawl spaces and basements of homes and office buildings, by the use of ventilators located in suitable openings of the enclosure walls. Such ventilators are generally provided with adjustable closure means, such as shutters or plates, to control the flow of air to and from the enclosed space, depending on temperature, weather conditions, or season change. Generally, such foundation wall ventilators are affixed in the wall opening by cement or mortar during construction of the wall.

One such ventilator device is disclosed in U.S. Pat. No. 3,436,016 and comprises a generally rectangular housing or box having movable louvers which are opened and closed by a temperature-responsive bimetallic spring. U.S. Pat. No. 3,528,606 also discloses a temperature-responsive foundation ventilator which is attached to a support grating or frame mounted in the masonry wall opening.

The present invention is directed to an improved ventilator construction which may be quickly, easily, and conveniently mounted in an existing opening of a masonry wall after construction, and without need to resort to permanent mortar attachment of the ventilator construction to the wall. In its broad aspects, the ventilator construction of the present invention comprises a louvered ventilator box having means for adjusting the position of the louvers of the box, and a supporting frame for the box which may be quickly and conveniently attached to and with the box in an existing opening of a masonry foundation wall. If desired, the ventilator box may be detached from its support frame and be utilized separately in foundation or other enclosure wall constructions.

Figure 1:
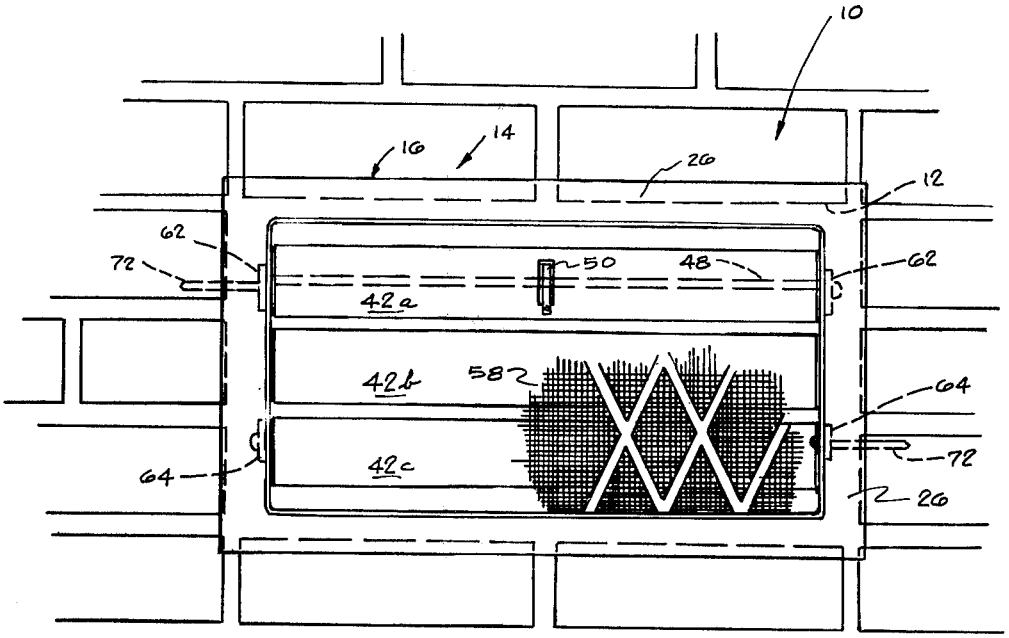
Figure 2:
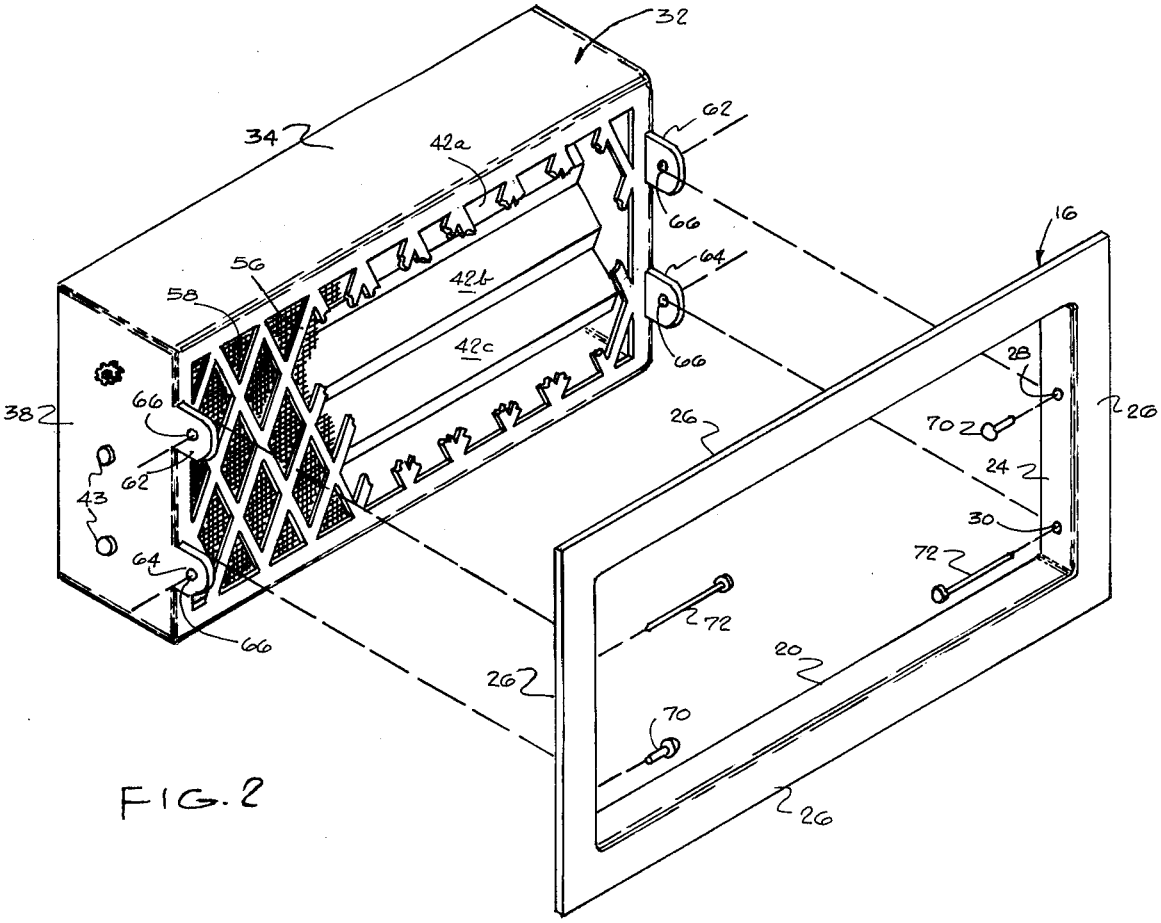
Figure 3:
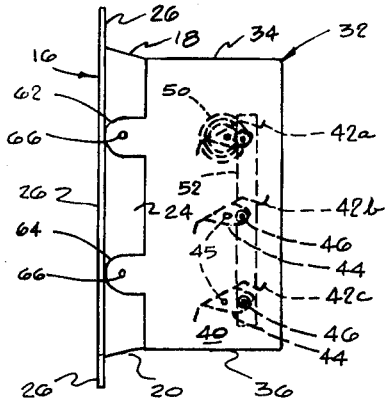

Details of the present invention will be best described and understood from the following description of a preferred embodiment of the invention, when taken with the accompanying drawings, in which:

FIG. 1 shows a portion of a brick foundation wall, with the ventilator construction of the present invention installed therein;

FIG. 2 is an exploded, perspective view of the ventilator construction of FIG. 1, with the support frame, ventilator box, and elements for attaching the frame and box to a masonry wall separated from their normal positions for better illustration; and FIG. 3 is a right hand, elevation view of the ventilator construction as seen in FIG. 1, with internal components of the ventilator construction shown in broken lines.

Referring more specifically to the drawings, FIG. 1 shows a portion of a brick foundation wall 10 having an opening 12 therethrough in which a ventilator construction 14 of the present invention is mounted. As will become evident, the ventilator construction is particularly suited and adapted for installation in existing openings of a masonry wall, both in new constructions and as a replacement for existing ventilators of the hand-operated closure type when it is desired to provide for automatic, temperature-responsive ventilator control for regulating air into the interior space.

As illustrated in FIGS. 1-3, ventilator construction 14 comprises a generally rectangular support frame 16 having generally horizontally disposed top and bottom walls 18, 20 and vertically disposed side walls, one of which 24 is shown in FIGS. 2 and 3, defining a rectangular passageway therethrough. Frame 16 further includes a peripheral flange 26 extending outwardly from the front edges of the walls generally perpendicular to the axis of the passageway to overlie the perimeter of an opening in a foundation wall. Located in vertically spaced relation in each of the side walls of support frame 16 are a pair of openings 28, 30 (FIG. 2) which receive fastening elements for attachment of the ventilator construction to the foundation wall, as will be explained.

Ventilator construction 14 further includes a generally rectangular ventilator box 32 having horizontal top and bottom walls 34, 36 and vertical side walls 38, 40 providing an air passageway containing three adjustable louvers **42*a*–42*c* therein. As seen in FIG. 3, each of the louvers is provided with fingerlike end plates 44 having a pair of openings 45, 46. The lower two louvers 42*b*, 42*c* are supportably attached at each end for rotational movement about their longitudinal axis to side walls 38, 40 by rivets 43** (FIG. 2)

Upper louver **42*a* is suitably supported for rotation on a stationary hexagonal rod 48 (FIG. 1) having its ends extending through the suitably sized circular opening 45 of respective end plates 44 and affixed against free rotation in side walls 38, 40 of box 32. A temperature-responsive coiled bimetallic spring assembly 50 (FIGS. 1 & 3) located in a central opening of louver 42*a* has its inner end attached to stationary rod 48 and its outer end attached to louver 42*a*. Louvers 42*a*–42*c* are interconnected for simultaneous rotary movement about their longitudinal axes by a vertically movable connecting arm 52 (FIG. 3) attached by pivot pins (not shown) extending through end plate openings 46. Thus, upon contraction and expansion of spring assembly 50** due to temperature changes, the three louvers are rotated in unison to open and close the ventilator box passageway.

The front end of the ventilator box passageway may be provided with a suitable grill 56 and protective screen 58 to protect the louvers, as well as prevent passage of insects, small animals, and the like through the ventilator box when the box is installed in a building wall.

Disposed in vertically spaced and outwardly extending relation from the front of the ventilator box on each side wall 38, 40 is a pair of ear-shaped members 62, 64 having openings 66 therethrough.

The ventilator construction of the present invention may be composed of any suitable high strength, light weight material, such as plastic, aluminum or other metal. The ventilator box 32 and support frame 16 may be conveniently formed of a high strength plastic, such as high density polyethylene or polypropylene in a molding operation, and the louvers 42 may be conveniently formed of aluminum sheet material.

To install the ventilator construction in an existing opening of a masonry foundation wall, the rear edge of the walls of the support frame 16 is positioned in abutting relation with the front face of ventilator box 32, with the ear-shaped connection elements 62, 64 of the ventilator box 32 lying on the outside face of the side walls of the frame 16, as seen in FIG. 3. Openings 66 of elements 62, 64 align with corresponding openings 28, 30 in each side wall of the support frame, and frame 16 and ventilator box 32 are attached by suitable means, such as plastic rivets 70, passed through diagonally opposed of the aligned openings in the support frame side walls and ventilator box elements 62, 64 (FIG. 2). The composite construction is then inserted into a suitably sized opening in the masonry wall with the flange 26 of the support frame overlying the periphery of the opening. The ventilator construction is firmly secured in the opening by suitable fastening means, such as concrete nails 72, which are passed through the remaining two diagonally opposed aligned openings of the frame and ventilator box and driven into the masonry of the foundation walls.

If it is desired to utilize the ventilator box by itself without the support frame, the box may be separated from the frame by removal of the plastic rivets 70, and the ventilator box installed in a wall opening in other suitable manners.

Although the preferred embodiment of ventilator construction shown and described herein utilizes a plurality of louvers and temperature-responsive spring assembly to control flow of air through the ventilator, other closure means, e.g., a single panel hinged to the ventilator box and manually or automatically operated, may be employed within the scope of the present invention.

From the foregoing detailed description of a preferred embodiment of the invention, it can be seen that the improved ventilator construction of the present invention may be employed in existing openings of masonry walls of new constructions, as well as replacements for ventilators in existing wall constructions, and may be installed therein in rapid, easy and simplified manner, without the necessity of securing the ventilator with concrete or mortar, as is generally the case with prior art foundation ventilators.

That which is claimed is:

1. An improved ventilator construction for a building wall comprising:

a. a generally rectangular support frame having opposed top and bottom walls and side walls defining a passageway therethrough, flange means attached to and extending outwardly from said walls generally perpendicular to the axis of said passageway for overlying the peripheral portion of an opening in a wall, and spaced openings through opposed of said support frame walls for receiving fastening means therethrough;

b. a generally rectangular ventilator box having opposed top and bottom walls and side walls defining an air passageway therethrough, screen means disposed across said air passageway, adjustable closure means in said ventilator box passageway and supportably attached to said ventilator box for opening and closing said passageway to the flow of air, and a plurality of spaced apart connection elements secured to opposed wall portions of said box generally parallel to the axis of said air passageway therethrough, said connection elements being spaced apart, protruding beyond the outer surface of said screen means and including openings disposed therethrough for alignment with said spaced openings in said support frame walls when said support frame and ventilator box are positioned in contiguous relation with their passageways aligned, whereby fastening means may be inserted through said aligned openings to secure said support frame and ventilator box together and within the opening of a building wall.

2. A construction as defined in claim 1 wherein said spaced openings through said support frame walls comprise a pair of vertically spaced openings in each of said side walls, and wherein said ventilator box connection elements comprise a pair of vertically spaced ear-shaped members extending from said opposed side walls for positioning outside said support frame passageway in closely spaced parallel relation to said opposed side walls thereof.

3. A construction as defined in claim 2 including fastening means positioned through diagonally opposed of said aligned openings of said support frame side walls and ventilator box ear-shaped members to connect said support frame and ventilator box to each other prior to installation in a building wall.

4. A construction as defined in claim 1 wherein said support frame and ventilator box are constructed of plastic.

5. A construction as defined in claim 1 including temperature-sensitive means operatively connected to said closure means for moving said closure means from opened to closed position across said passageway in response to changes in ambient temperatures.

* * * * *